US006763623B2

(12) United States Patent
Piana

(10) Patent No.: US 6,763,623 B2
(45) Date of Patent: Jul. 20, 2004

(54) PRINTED RIGID MULTIPLE TAGS, PRINTABLE WITH A THERMAL TRANSFER PRINTER FOR MARKING OF ELECTROTECHNICAL AND ELECTRONIC ELEMENTS

(75) Inventor: Ivana Piana, Predosa (IT)

(73) Assignee: Grafoplast S.P.A., Predosa (IT)

( * ) Notice: Subject to any disclaimer, the term of this patent is extended or adjusted under 35 U.S.C. 154(b) by 0 days.

(21) Appl. No.: 10/213,566

(22) Filed: Aug. 7, 2002

(65) Prior Publication Data

US 2004/0025386 A1 Feb. 12, 2004

(51) Int. Cl.[7] ..... G09F 3/04
(52) U.S. Cl. ..... 40/316; 40/674
(58) Field of Search ..... 40/316, 674, 660, 40/661.11; 428/43

(56) References Cited

U.S. PATENT DOCUMENTS 1,309,904 A * 7/1919 Mills et al. ..... 40/672
3,985,852 A * 10/1976 Evans ..... 264/132
5,110,638 A * 5/1992 Vogdes et al. ..... 428/35.1
5,117,570 A * 6/1992 Morosini ..... 40/316
5,187,854 A * 2/1993 Bossi ..... 29/451
5,766,705 A 6/1998 Weber
6,277,456 B1 * 8/2001 Bulgrin et al. ..... 428/40.1

FOREIGN PATENT DOCUMENTS

| | | |
|---|---|---|
| EP | 0 185 518 | 6/1986 |
| EP | 0 752 693 | 1/1997 |
| FR | 2 689 285 | 10/1993 |
| GB | 2 314 547 | 1/1998 |

* cited by examiner

*Primary Examiner*—Cassandra Davis
(74) *Attorney, Agent, or Firm*—Richard M. Goldberg

(57) ABSTRACT

Printed multiple tags for marking electro technical and/or electronic elements, include a rigid injection molded plastic plate made of thermoplastic material and including several comb shaped units, each comb shaped unit including interpenetrating teeth which form tags and which are separated by through passing cutting lines separating the interpenetrating teeth and by first non passing-through prefracture lines which facilitate detachment of the tags, second non passing-through prefacture lines to facilitate detachment of the comb shaped units from each other, and the tags being marked with indicia by a thermal transfer printer for rigid plates by a computer system, to form printed tags which are adapted to be placed in supports after being detached from their respective comb shaped unit, with the supports being fitted on electronic elements to be identified.

6 Claims, 2 Drawing Sheets

PRINTED RIGID MULTIPLE TAGS, PRINTABLE WITH A THERMAL TRANSFER PRINTER FOR MARKING OF ELECTROTECHNICAL AND ELECTRONIC ELEMENTS

BACKGROUND OF THE INVENTION

This invention covers a marking system for electronic components (cables, systems, instruments, control panels etc.). Identification and marking systems consisting of elements or multiple tags on which characters or references are printed during production or by plotter based computer software have long been known. These marking systems, if compared with the manual composition of the marking elements permits fairly quick and accurate marking even for large marking series. However, plotter printing takes a rather long time as compared with the most recent printers now available on the market.

SUMMARY OF THE INVENTION

According to this invention, instead of the above described systems where the tags are composed of individual marking elements or computerised by plotter, the marking tags are now printed on prepacked rigid plastic plates with a thermal transfer printer.

According to this invention, this prepacked rigid plate features a set of crosswise arranged tags alternating with suitable, usually through-passing cutting lines and non through-passing prefracture lines.. These through-passing and non through-passing cutting lines permit to separate the various comb elements from the plate after it has been printed; these marking elements may then be fitted in special supporting sleeves or they may be directly applied to identify terminal blocks and contactors, etc.

The plate is in rigid thermoplastic material obtained by injection moulding in a way which permits its utilisation by a printer of the above described type.

BRIEF DESCRIPTION OF THE DRAWINGS

The system, subject matter of this invention is illustrated in its practical and exemplified implementation in the attached drawings in which.

DETAILED DESCRIPTION

Figure 1:
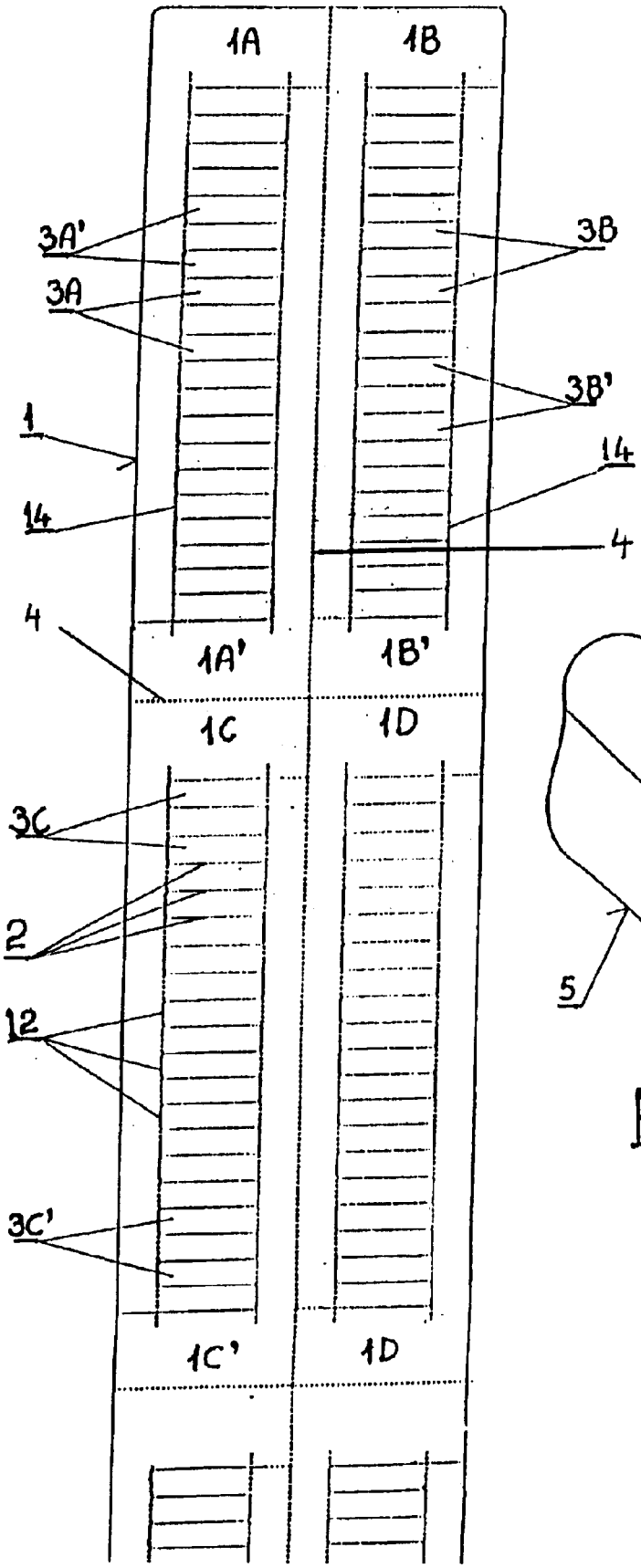
FIG. 1 shows a top view of an exemplified injection moulded plate.
Figure 2:
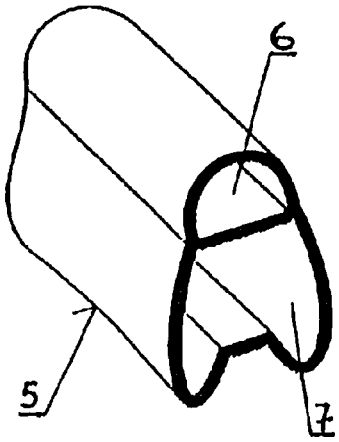
FIG. 2 shows an exemplified marking sleeve.

With reference to these Figures, the plate 1 consists of various comb shaped units, for example, comb shaped unit 1A, 1A' adjacent to comb shaped unit 1B,1B' and comb shaped unit 1C,1C', and a further comb shaped unit 1D,1D' adjacent comb shaped units 1B,1B' and 1C,1C', these comb shaped units being obtained from one single plate 1 in rigid material such as injection moulded thermoplastic material. Cutting lines 2, which are usually through-passing but may also be non through passing, are provided to separate adjacent interpenetrating teeth 3A,3A', 3B,3B', 3C,3C', etc., of the comb from each other, whereas non through-passing prefracture or precutting lines 4 are created to detach the comb-shaped units 1A,1A', 1B,1B', etc. from each other and non through-passing prefracture or precutting lines 14 are created to detach the various single marking tags 3A,3A', 3B,3B', etc. from the comb shaped units. These non through-passing prefracture lines are indicated in the drawing by the dotted lines 4 and 14, respectively.

The teeth may be separated from the comb shaped units by through-passing cutting lines 12 or by prefracture or pre-cutting lines 12, and this permits to provide the printer with a plate 1 having a perfectly smooth lower surface resting on the printer.

Figure 3:
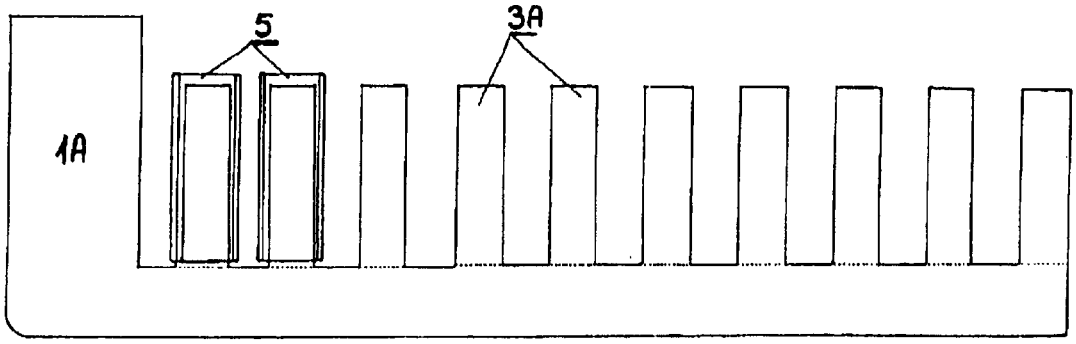
FIG. 3 shows a magnified top view of the comb-shaped device from which the marking elements are obtained.

After this definition of the plate assembly, the various characters required for marking may be printed on the tags which may then be separated from the comb assemblies 1A,1A', 1B,1B', etc. so that a support (sleeve) 5 may be placed on each tag; this sleeve features a recess 6 at its upper end in which to slip the marked tag, whereas the lower part of the sleeve is designed to secure the support to the electronic element to be identified. In the example, this lower portion 7 is designed to be mounted on medium/small sized cables 8 as shown in FIG. 3, whereas other configurations may be adopted for larger sized cables or for the marking of other electronic elements, as normally used.

Figure 4:
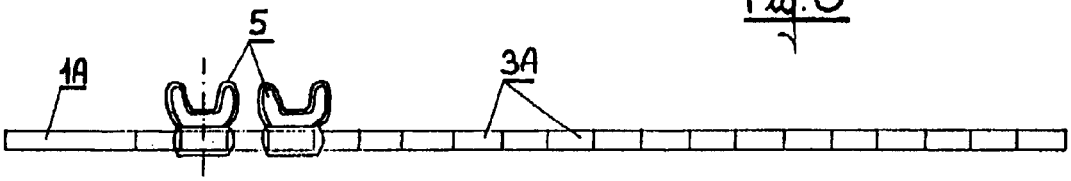
FIG. 4 shows a side view of the comb-shaped element of FIG. 3.
Figure 5:
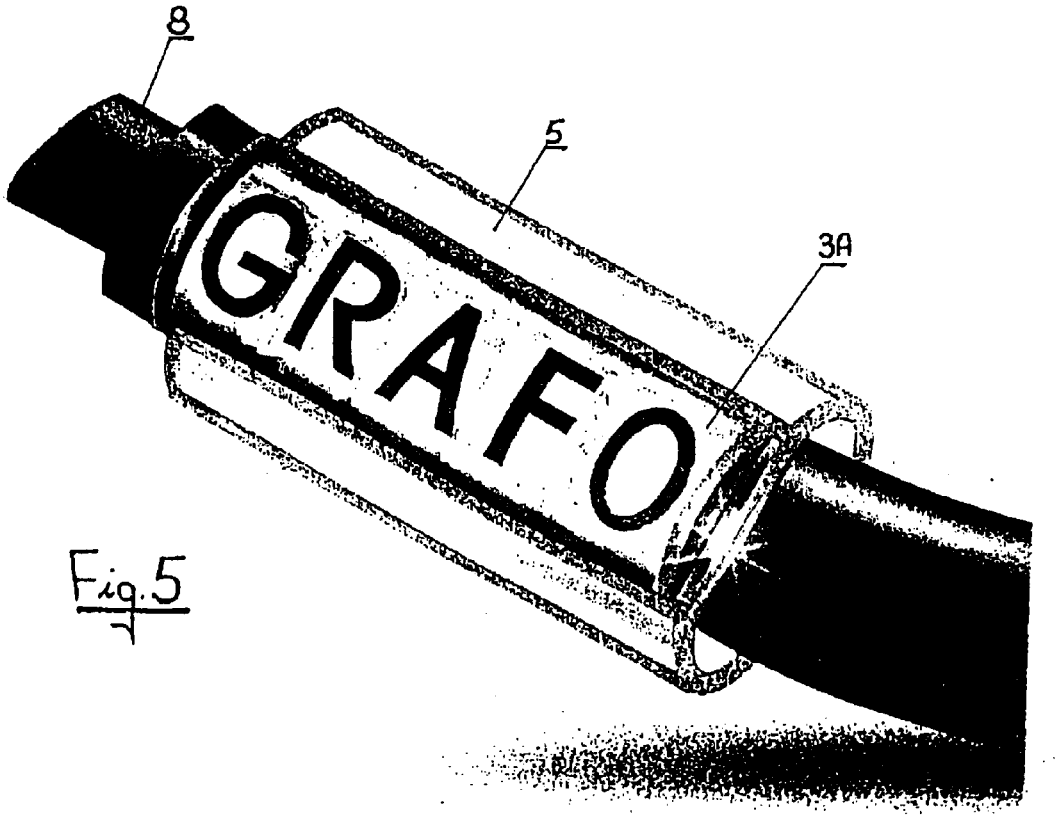
FIG. 5 shows a perspective view of the marking tags used to identify a cable.

The markings on the tags are printed with a thermal transfer printer specifically designed for rigid plates. After computer controlled printing with special software named SIMPLO 2000, the various comb assemblies are detached, the supporting sleeves are inserted as shown in FIGS. 3 and 4 and the tags and sleeves are then detached from their common comb-shaped support to be fitted on the items to be identified, while keeping in mind that these tags are also used to mark terminal blocks and contactors etc. already provided with a support. FIG. 5 shows, for example, the marking of a cable 8 featuring the exemplar word "GRAFO" printed on the tag.

The plate consisting of various comb units shown in FIG. 1 will usually consist of three consecutive elements and two elements placed abreast, but the number of consecutive and side by side positioned elements may also be varied.

These new marking tags are compatible with all normal and known marking elements already produced by the Applicant and may also be used in support or instead of the "Plotter System" series where a normal plotter is used for marking of the tags.

What is claimed is:

1. Printed multiple tags for marking electrotechnical and/or electronic elements, comprising:

a rigid injection molded plastic plate made of thermoplastic material and including several comb shaped units, each said comb shaped unit including adjacent interpenetrating teeth which form tags and which adjacent teeth of the same comb shared unit are separated by through passing cutting lines separating the interpenetrating teeth of the same comb shaped unit and by first non passing-through prefracture lines which facilitate detachment of the tags of the same comb shaped unit, second non passing-through prefracture lines to facilitate detachment of the comb shaped units from each other, and said tags being marked with indicia by a thermal transfer printer for rigid plates by a computer system, to form printed tags which are adapted to be placed in supports after being detached from their respective comb shaped unit, with the supports being fitted on electronic elements to be identified.

2. Printed multiple tags according to claim 1, further comprising second through passing cutting lines provided on one end of each tooth of each said comb shaped unit, and said first non passing-through prefracture lines are provided on an opposite end of each tooth of each said comb shaped unit.

3. Printed multiple tags according to claim 2, wherein each said tooth has a rectangular configuration, and the first through passing cutting lines are provided on opposite longer edges of each tooth of each said comb shaped unit.

4. Printed multiple tags according to claim 3, wherein said comb shaped units extend in a lengthwise direction, and said one end and said opposite end are shorter edges that extend in said lengthwise direction, and said opposite longer edges extend in a direction transverse to said lengthwise direction.

5. Printed multiple tags according to claim 1, wherein the comb shaped units of each plate are arranged in two adjacent connected columns, with each column including a plurality of comb shaped units.

6. Printed multiple tags for marking electro technical and/or electronic elements, comprising:

a rigid injection molded plastic plate made of thermoplastic material and including several comb shaped units, each said comb shaped unit including interpenetrating teeth which form tags and which are separated by first non passing-through prefracture lines which facilitate separation of the teeth of the plate and thereby detachment of the tags, second non passing-through prefacture lines to facilitate detachment of the comb shaped units from each other, and said tags being marked with indicia by a thermal transfer printer for rigid plates by a computer system, to form printed tags which are adapted to be placed in supports after being detached from their respective comb shaped unit, with the supports being fitted on electronic elements to be identified.

* * * * *